US005529024A

United States Patent [19]

Wirbeleit et al.

[11] Patent Number: 5,529,024

[45] Date of Patent: Jun. 25, 1996

[54] FUEL INJECTION SYSTEM FOR AN INTERNAL-COMBUSTION ENGINE

[75] Inventors: Friedrich Wirbeleit, Esslingen; Alois Raab, Aalen; Wolfgang Lehner, Esslingen, all of Germany

[73] Assignee: Daimler-Benz A.G., Stuttgart, Germany

[21] Appl. No.: 329,289

[22] Filed: Oct. 26, 1994

[30] Foreign Application Priority Data

Oct. 29, 1993 [DE] Germany ..... 43 37 048.9

[51] Int. Cl.[6] ..... F02B 47/02

[52] U.S. Cl. ..... 123/25 C; 123/447; 239/96

[58] Field of Search ..... 123/25 R, 25 C, 123/575, 447, 525, 526, 27 GE; 239/96

[56] References Cited

U.S. PATENT DOCUMENTS

| | | | |
|---|---|---|---|
| Re. 33,270 | 7/1990 | Beck et al. | 123/447 |
| 4,417,447 | 11/1983 | Thomas | 123/25 C |
| 5,170,751 | 12/1992 | Tosa et al. | 123/25 C |
| 5,174,247 | 12/1992 | Tosa et al. | 123/25 C |
| 5,243,932 | 9/1993 | Herrmann | 123/575 |
| 5,271,370 | 12/1993 | Shimada et al. | 123/575 |

FOREIGN PATENT DOCUMENTS

| | | | |
|---|---|---|---|
| 0282819 | 9/1988 | European Pat. Off. . | |
| 0304746 | 6/1989 | European Pat. Off. . | |
| 0459429 | 12/1991 | European Pat. Off. . | |
| 0459083 | 12/1991 | European Pat. Off. . | |
| 0553364 | 8/1993 | European Pat. Off. . | |
| 2252307 | 4/1973 | Germany . | |
| 254752 | 3/1988 | Germany . | |
| 8001190 | 6/1980 | WIPO | 123/25 C |

*Primary Examiner*—Erick R. Solis
*Attorney, Agent, or Firm*—Klaus J. Bach

[57] ABSTRACT

In a fuel injection system for an internal-combustion engine which includes a dual-fluid nozzle which is supplied with fuel by a high-pressure pump and with water by a feed pump providing a substantially lower pressure than the high-pressure pump and which has disposed in a nozzle body a nozzle needle which is spring biased into a closing position where one end of the needle is seated on a valve seat, a fuel supply passage extends to an annular space around the valve needle and a branch passage leads to a control chamber formed at the other end of the valve needle and includes a solenoid valve for controlling the application of pressurized fluid to, and the release thereof from, the other end of the nozzle needle, an additional fluid line extends from the feed pump to the annular space and includes a check valve for permitting flow of additional fluid only toward the annular space and a pressure relief line in communication with the fuel supply passage via a control valve, and a control device is provided for operating the solenoid valve for timed relief of fluid pressure from the control chamber for unseating the nozzle needle and for operating the control valve to either supply fuel under pressure to the annular chamber or releasing pressure from the annular space so as to permit feeding of water into the annular space for subsequent injection, together with the fuel, from the dual-fluid nozzle.

4 Claims, 1 Drawing Sheet

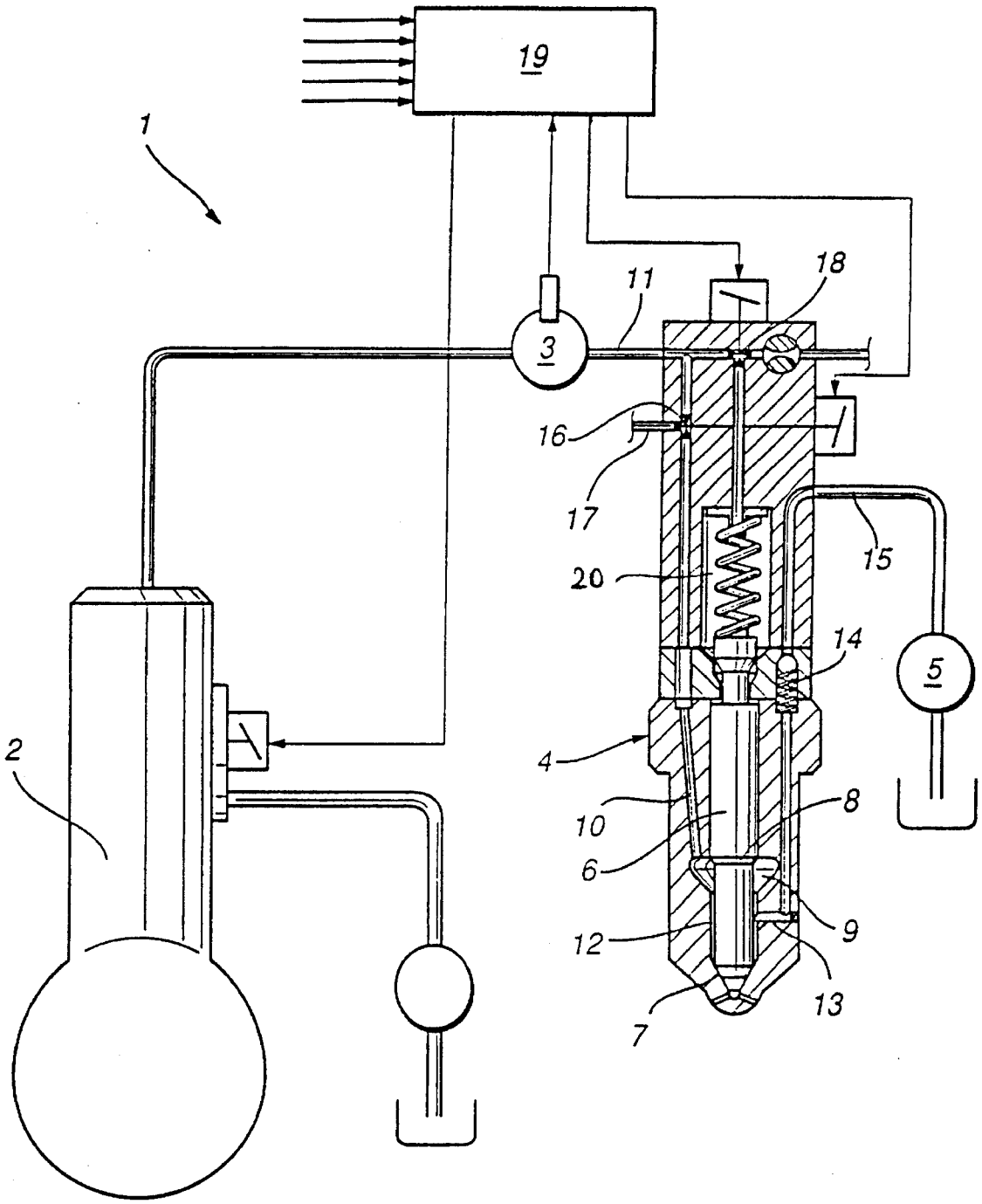
19
1
11
18
3
16
17
15
20
14
5
2
4
10
8
6
9
12
13
7

FUEL INJECTION SYSTEM FOR AN INTERNAL-COMBUSTION ENGINE

BACKGROUND OF THE INVENTION

The invention relates to a fuel injection system for an internal-combustion engine, having a high-pressure pump for feeding the fuel into a dual-fluid nozzle, and also means for supplying a second fluid to the dual-fluid nozzle.

As known, peak combustion chamber temperatures, and consequently nitrogen oxides, can be reduced by selectively injecting water into the combustion chamber while combustion takes place.

EP 0 282 819 A2 discloses, for example, a fuel injection system designed as a dual-fluid system, in which water fed by a feed pump is stored during an injection pause in a pressure space of the dual-fluid nozzle and is injected with the subsequently supplied diesel fuel into the combustion chamber for reducing nitrogen oxide emission. The respective quantity of water is determined by a control valve in an additional fluid line. During the storing of the water, an automatically opening pressure valve in the high-pressure pump provides relief in the high-pressure line.

It is the object of the invention to improve the fuel injection system in such a way that a feed pump for the additional fluid of relatively low pumping capacity is used independently of the level of the system pressure in the high-pressure line and that, after injection, a rapid pressure build-up can be reestablished in the high-pressure line.

SUMMARY OF THE INVENTION

In a fuel injection system for an internal-combustion engine which includes a dual-fluid nozzle which is supplied with fuel by a high-pressure pump and with water by a feed pump providing a substantially lower pressure than the high-pressure pump and which has disposed in a nozzle body a nozzle needle which is spring biased into a closing position where one end of the needle is seated on a valve seat, a fuel supply passage extends to an annular space around the valve needle and a branch passage leads to a control chamber formed at the other end of the valve needle and includes a solenoid valve for controlling the application of pressurized fluid to, and the release thereof from, the other end of the nozzle needle, an additional fluid line extends from the feed pump to the annular space and includes a check valve for permitting flow of additional fluid only toward the annular space and a pressure relief line in communication with the fuel supply passage via a control valve, and a control device is provided for operating the solenoid valve for timed relief of fluid pressure from the control chamber for unseating the nozzle needle and for operating the control valve to either supply fuel under pressure to the annular chamber or releasing pressure from the annular space so as to permit feeding of water into the annular space for subsequent injection, together with the fuel, from the dual-fluid nozzle.

Due to the special arrangement of the control valve and the possibility of shutting off the high-pressure fuel line to the dual-fluid nozzle and at the same time providing for a relief communication path from the annular space at the nozzle front end, only a low power feed pump is required for the introduction of the water (second fluid), as it has to overcome only the spring force of the check valve in the additional fluid line leading to the dual-fluid nozzle. In addition, after each injection, the system pressure is built up again in a very short time due to the short flow path from the control valve to the nozzle front end, which consequently also results in a lower energy consumption of the high-pressure pump.

Preferably the annular space at the front end of the nozzle needles is elongated and the additional fluid line joins the annular space at a predetermined distance from the nozzle needle seat so that an intermediate storing of the additional fluid, or a stratification comprising fuel—additional fluid—fuel, takes place with the effect that first fuel is injected and then, after ignition of the fuel, the water follows whereby a specific lowering of the peak temperature is achieved and the production of $NO_x$ is effectively prevented.

An exemplary embodiment of the invention is shown in the drawing and explained in greater detail in the description.

BRIEF DESCRIPTION OF THE DRAWING

The sole FIGURE shows schematically the duel-fluid injection system according to the invention.

DESCRIPTION OF THE PREFERRED EMBODIMENT

A fuel injection system 1, that is a dual-fluid injection system for a diesel internal-combustion engine, essentially comprises a high-pressure pump 2 for feeding diesel fuel to a common supply line 3 (common rail) from which the fuel is supplied to a solenoid valve-controlled dual-fluid nozzle 4, and also a low-power feed pump 5 for feeding water to the nozzles 4.

The dual-fluid nozzle 4 includes a spring-loaded nozzle needle 6, which has a front end seated on a valve seat 7 and which is lifted off its valve seat 7 under the pressure of the fuel supplied thereto in a direction opposite to the direction of fluid flow through the nozzle. A pressure shoulder 8 of the nozzle needle 6 bounds a pressure space 9 to which a fuel supply passage 10 extends within the dual-fluid nozzle 4 from the injection line 11 which is connected to the common supply line 3. Between pressure space 9 and valve seat 7 there is an annular space 12, which surrounds the nozzle needle 6 and into which leads—at a defined distance from the valve seat 7—a metering bore 13 of an additional fluid line 15 which includes a check valve 14.

The fuel supply passage 10 includes a control valve 16, which is designed as an electromagnetically operable three-way valve, by which either the high-pressure connection between the supply line 3 and the pressure space 9 and the annular space 12 of the dual-fluid nozzle 4 or a relief path between the annular space 12 and a relief line 17 can be established. The relief line 17 may be a leakage line leading back to a fuel tank. Preferably the control valve 16 is arranged as close to the annular space 12 as possible such that the passage 10 from the annular space 12 to the control valve 16 is short to facilitate the return flow of the fuel displaced from the annular space 12 by water supplied thereto while the control valve 16 opens the relief line 17 for reestablishment of high pressure conditions in the annular space upon completion of the water input.

A solenoid valve 18, also designed as a three-way valve, is located at the end of the nozzle opposite the nozzle needle 6. A control chamber 20 at the nozzle needle rear end can be placed by the solenoid valve 18 in communication with the high-pressure injection line 11 or a low-pressure line and consequently the nozzle needle 6 can be controlled with regard to the beginning of injection and the duration of the injection by the solenoid valve 18.

Control valve 16 and solenoid valve 18 can be actuated by an electronic control device 19, operating depending on various operating parameters.

Operation of the Dual-Fluid Nozzle:

During each injection cycle the annular space 12 and the pressure space 9 are briefly relieved of the high pressure, which is, for example, 1500 bar, by the control valve 16 to permit the storing of water in the annular space 12. The water is supplied by the feed pump 5 at a relatively low pressure of about 20 bar. The quantity of water supplied via the check valve 14 into the annular space 12 displaces an equivalent volume of fuel via the relief line 17. The control valve 16 in this case assumes the function of metering the quantity of water, since the quantity of water admitted at a constant feed pressure is proportional to the switching time of the control valve 16.

As soon as the control valve 16 is deenergized, the admission of water at the full high pressure becomes effective again in the pressure space 9. The check valve 14 closes so as to prevent the return of the water.

When the solenoid valve 18 is actuated by a signal from the control device 19 the high pressure at the back side of the nozzle needle is relieved thereby permitting the high-pressure fuel acting on the pressure shoulder 8 to lift the nozzle needle 6 and the stratified injection of diesel fuel-water-diesel fuel takes place until the solenoid valve 18 is deenergized and high pressure is again established at the back side of the nozzle needle to close the nozzle needle valve.

What is claimed is:

1. A fuel-injection system for an internal-combustion engine, comprising a dual-fluid nozzle mounted on the engine, a high-pressure pump for supplying liquid fuel fluid to said dual-fluid nozzle, a feed pump for supplying an additional liquid fluid, to said dual-fluid nozzle, said dual-fluid nozzle having a body including a nozzle needle which is spring-biased into a closing position in which one end of said needle is seated on a valve seat, an annular space formed around said valve needle adjacent said one end of said valve needle, a fuel supply passage extending from said annular space through said nozzle body and being in communication with said high-pressure fuel pump, said fuel supply passage having a branch passage leading to a control chamber formed in said nozzle body at the other end of said valve needle, said branch passage including a solenoid valve for applying fluid pressure to the other end of said nozzle needle and for relieving said fluid pressure whereby closing and opening of said nozzle needle is achieved, an additional fluid line extending from said feed pump to said annular space for supplying said additional fluid thereto under a pressure substantially lower than the fuel pressure generated by said high-pressure pump, said additional fluid line including a check valve for preventing return flow of said additional fluid out of said annular space, a pressure relief line in communication with said fuel supply passage via a three-way control valve arranged therein, and a control device for operating said solenoid valve for timed relief of fluid pressure from said control chamber for unseating said nozzle needle and for application of fluid pressure to said control chamber for seating said valve needle and also for operating said control valve for either supplying pressurized fuel to said annular chamber or for blocking the pressurized fuel supply and placing said annular chamber in communication with said pressure relief line, while said nozzle needle is seated to permit feeding of said additional fluid into said annular space for the time period during which said control valve establishes said communication.

2. A fuel injection system according to claim 1, wherein said control valve is an electromagnetic three-way valve arranged in the high-pressure fuel passage between a supply line by which a plurality of dual-fluid nozzles of the engine are supplied with fuel under pressure and the annular space of a particular dual-fluid nozzle.

3. A fuel injection system according to claim 1, wherein the additional fluid line joins said annular space around the nozzle needle at a predetermined distance from the nozzle needle valve seat.

4. A fuel injection system according to claim 1, wherein said control valve is arranged in said dual-fluid nozzle in close proximity to the annular space at said one end of the nozzle needle where a majority of the volume of additional fluid is stored.

* * * * *